United States Patent [19]

Halbrook

[11] Patent Number: 4,664,331

[45] Date of Patent: May 12, 1987

[54] TRAIL CABLE PICKUP REEL

[75] Inventor: Billie L. Halbrook, Gillette, Wyo.

[73] Assignee: Cordero Mining Co., Lakewood, Colo.

[21] Appl. No.: 746,591

[22] Filed: Jun. 19, 1985

[51] Int. Cl.[4] ..... B65H 75/40; B66D 1/00; H02G 11/00

[52] U.S. Cl. ..... 242/86.5 R; 254/323; 254/360; 254/365; 191/12.2 R; 191/12.2 A

[58] Field of Search ..... 242/86.5 R, 86.51, 86.52; 254/323, 328, 361, 365; 191/12.2 R, 12.2 A, 12.4

[56] References Cited

U.S. PATENT DOCUMENTS

| | | | |
|---|---|---|---|
| 899,613 | 9/1908 | Pifer | 191/12.2 R |
| 1,765,547 | 6/1930 | Sloane | 192/2 |
| 2,495,425 | 1/1950 | Schultz et al. | 254/266 |
| 2,655,567 | 10/1953 | Woolf | 191/12.2 A |
| 3,027,141 | 3/1962 | Ellis | 254/323 |
| 3,033,488 | 5/1962 | Weber | 242/107.5 |
| 3,227,421 | 1/1966 | Andersen | 254/358 |
| 3,356,341 | 12/1967 | Brown | 242/86.5 R X |
| 3,429,374 | 2/1969 | Pridy | 166/65 |
| 3,632,054 | 1/1972 | Heppelmann et al. | 242/86.5 R |
| 3,861,505 | 1/1975 | Sugimura | 191/12.2 R |
| 3,876,045 | 4/1975 | Knarreborg | 191/12.2 R |
| 3,912,225 | 10/1975 | Earnheart | 242/86.5 R X |
| 3,915,022 | 10/1975 | Walton | 74/99 |
| 4,114,827 | 9/1978 | Maier | 242/86.51 |

*Primary Examiner*—Stuart S. Levy
*Assistant Examiner*—David Werner
*Attorney, Agent, or Firm*—J. Edward Hess; Donald R. Johnson; Stanford M. Back

[57] ABSTRACT

An electric power cable reeling apparatus that can be detachably attached to a rubber tired dozer. The reeling apparatus comprises a frame that is provided with a hydraulic motor and clutch assembly for rotating the cable reel shaft for reeling in the cable. The frame is also provided with jacks that are used to maintain the frame at a selected vertical position. A split bearing assembly is used to hold the cable reel shaft onto the frame. By adjusting the vertical position of the frame the cable reel can be easily mounted or dismounted by rolling the cable reel on or off.

9 Claims, 10 Drawing Figures

TRAIL CABLE PICKUP REEL

BACKGROUND OF THE INVENTION

1. Field of the Invention

The invention is related to an electric power cable reel handling apparatus and specifically to an apparatus that can be detachably mounted to a rubber tired dozer. The dozer through the dozer blade tilt hydraulic circuit supplies power to rotate the cable reel thereby reeling in loose power cable.

2. Description of the Prior Art

In the surface mining operations large electrical machines are used to excavate the mine. Electrical power is supplied to these machines through electric power cables. As such, at one time or another, it becomes necessary to move the cables to another location, and in and out of shops for repair and replacement.

It is common practice at many times to drag the cables from one location to another, or to coil the cables on skids and then move them. Both of these methods can be hazardous. Dragging the cable damages the cable's insulative cover and may cause electric current leakage from the cable. Coiling the cable on a skid takes at least four workers while another worker drags the skid with a tractor. There is always a possibility during this operation that a person may become entangled in the cable.

Many large machines, such as tracked dozers and mine locomotives, have been provided with cable reeling apparatuses that either coil electric power cable, or act as winches by pulling cable onto a coil, see U.S. Pat. Nos. 2,655,567, 3,027,141, 3,227,421 and 3,861,505. These devices may be powered by fluid motors which are connected to the vehicle's hydraulic system, see U.S. Pat. Nos. 1,765,547, 3,915,022 and 4,114,827.

Other electric power cable reeling devices have been proposed, see U.S. Pat. Nos. 899,613, 3,033,488, 3,429,374 and 3,876,045. It has also been suggested that a reeling device can be provided with jacks so that the reel shaft can be mounted in axial alignment with the power take-off of a vehicle, see U.S. Pat. No. 2,495,425.

SUMMARY

It is the object of the present invention to safely and economically reel in, transport and unreel excavator electric power cable. It is further the object of the present invention to employ interchangeable reels with the apparatus, wherein the apparatus provides a means for simply, safely and quickly changing reels.

Another object of the invention is to provide an apparatus that can be easily coupled to a rubber tired dozer without removing the blade of the dozer, and is also able to use the hydraulic circuit of the dozer to operate the cable reel.

The above objects are accomplished by the disclosed apparatus which comprises a tubular frame having split bearing assemblies for receiving the shaft of the reel drum, and a fluid motor and associated clutch that rotate the shaft for reeling in cable.

The frame is provided with vehicle mounting means for mounting the frame onto a vehicle such as a rubber tired dozer. The vehicle would be used to supply pressurized hydraulic fluid to the fluid motor and also to horizontally transport the apparatus.

The frame is also provided with telescoping jack means that can maintain the frame and apparatus at various vertical positions for facilitating the mounting of the reel and the use of the apparatus.

DETAILED DESCRIPTION

Figure 1:
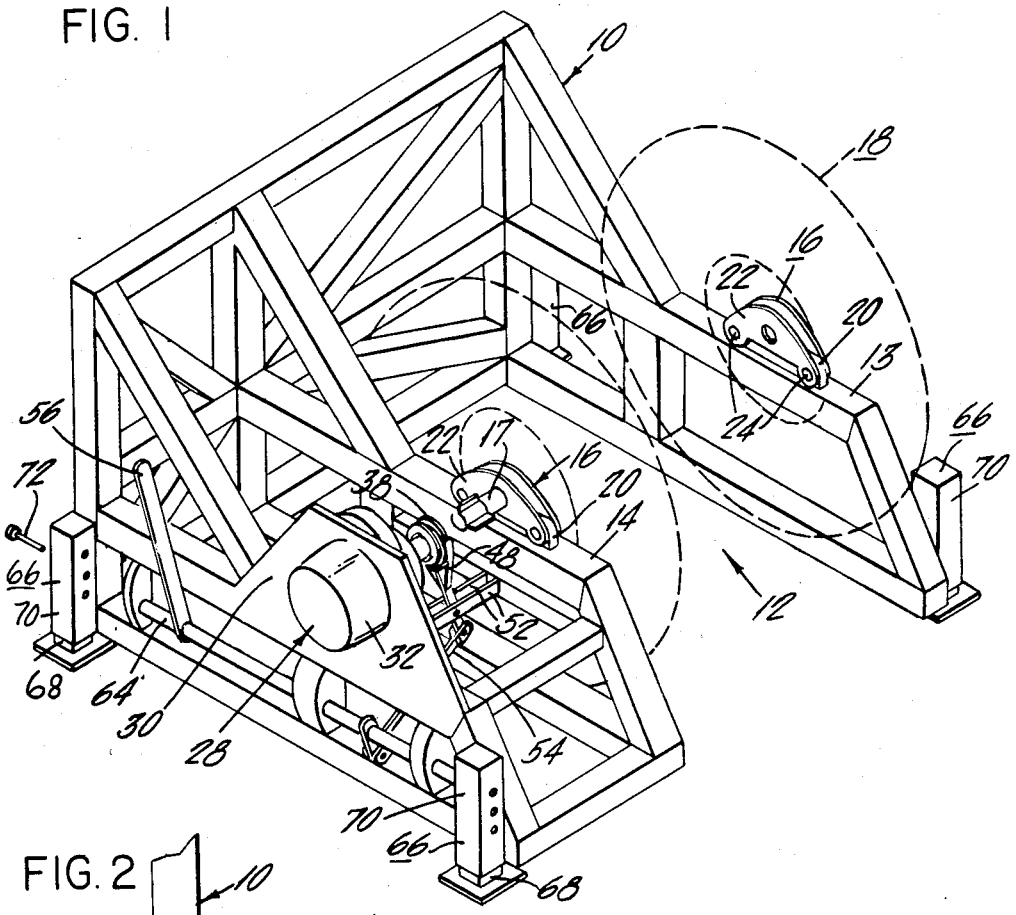
FIG. 1, is a perspective view of the apparatus.

The apparatus illustrated in FIG. 1 comprises a frame 10 formed of rectangular tubular members that are cross braced with various tubular struts as illustrated. The frame is provided with reel receiving portion 12 which comprises horizontal frame members 13 and 14 on which are mounted split bearing assemblies 16. The split bearing assemblies lock about shaft 17 of cable reel 18 (shown in phantom lines) to hold it on the frame. The split bearings comprise lower bearing assembly 20 and upper bearing assembly 22 that are coupled together by pins 24.

Figure 2:
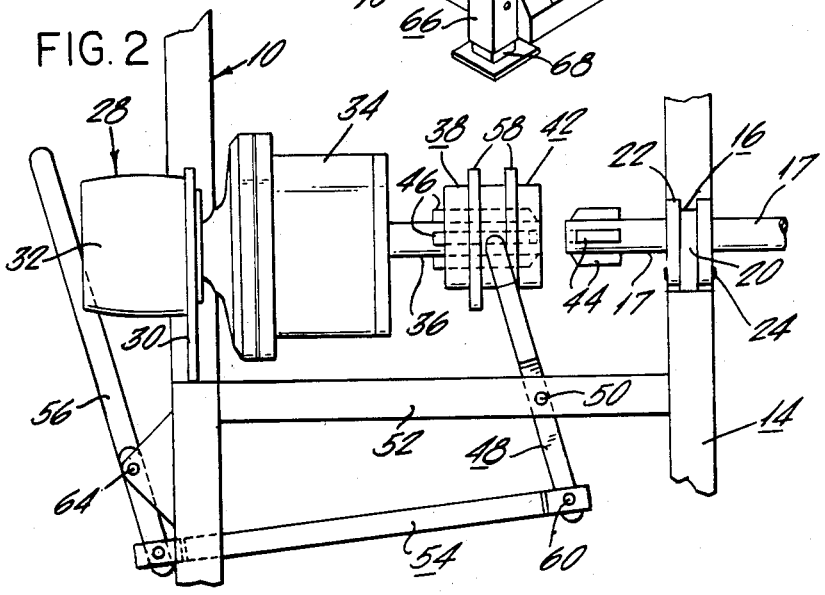
FIG. 2, is a partial view of the apparatus illustrating the fluid motor and clutch assembly.

The frame is also provided with motor receiving portion 28 formed by horizontal frame member 14 and vertical plate 30. Hydraulic fluid motor means 32 is mounted to plate 30 and is provided with torque hub 34 which rotates shaft 36. In addition, a slidable clutch sleeve 38 is positioned about shaft 36, see FIG. 2. The split bearing assembly on frame member 14 holds shaft 17 of the cable reel adjacent to the motor shaft 36 in an axially aligned relation to the motor shaft.

The clutch assembly comprises hollow sleeve 42 which is provided with inner radial grooves that may engage raised portions 44 and 46 located on the cable reel shaft and the motor shaft, respectively. The raised portions form splines through which rotation can be transmitted. The clutch can be linearly positioned along the shafts by moving Y-shaped yoke 48 which is pivoted at 50 between frame members 52. By positioning the sleeve so that the raised portions of both shafts are engaged in the sleeve, rotational movement from the motor shaft can be transmitted to the cable reel shaft. By moving the sleeve to the left (in FIG. 2) cable shaft 17 is operationally disengaged form the motor and therefore ceases rotation.

The clutch actuating mechanism comprises Y-shaped yoke 48, link 54 and operating handle 56. The Y-shaped yoke allows the sleeve to rotate freely and only confines the linear movement of the sleeve, by contacting flanges 58 on the sleeve. As discussed before, the yoke is pivoted at 50 and connected to the link 54 at 60. The link is operationally coupled to handle 62 by axle 64. Therefore by manipulating the handle, link 54 is moved which transmits this control motion to yoke 48 which moves the clutch sleeve accordingly.

Figure 9:
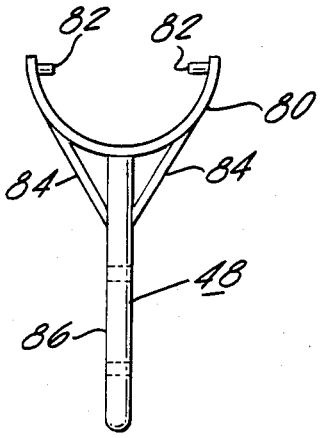
FIGS. 9–10, are front and side views of the Y-shaped yoke.
Figure 10:
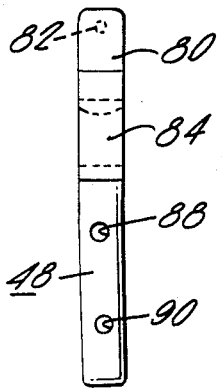

The Y-shaped yoke is better illustrated in FIGS. 9 and 10. The yoke comprises a U-shaped flange receiving portion 80 having inwardly extending knobs 82 which are operationally positioned between flanges 58. The U-shaped portion is supported on struts 84 and pivot rod 86. Rod 86 is provided with apertures 88 and 90 which act as connecting points for pivot point 50 and connecting point 60, respectively.

Each of the four corners of the frame is provided with a jack 66 that is used to maintain the frame at a selected vertical position. The jacks are formed of inner tubes 68 that telescope into outer tubes 70. Each tube is provided with registration holes through which a pin 72 can be inserted for holding the jack in the selected vertical position. As such the frame must first be vertically positioned by another means and then the jacks pinned to maintain the frame at the selected position. It should be noted however, that self actuating jacks which are either manually or hydraulically powered may also be used if desired.

Figure 3:
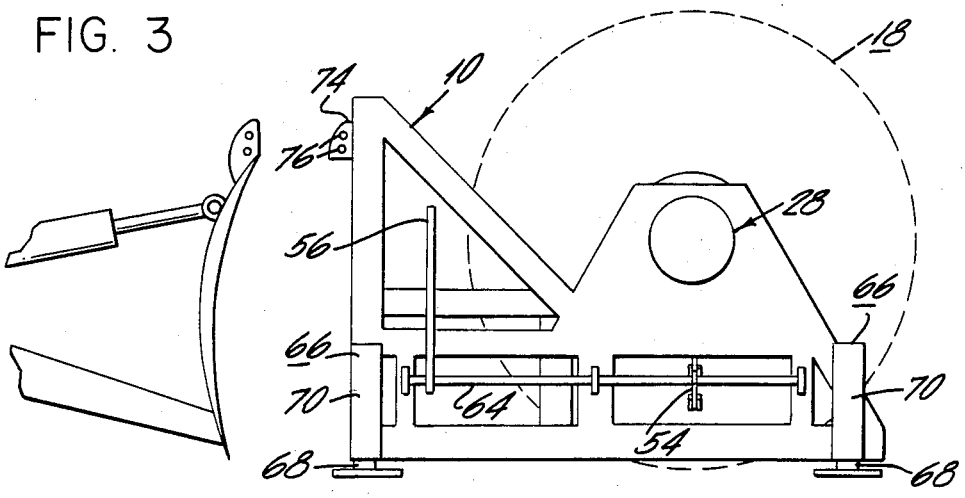
FIGS. 3–7, are side views of the apparatus in various jacking and handling configurations.

The frame is also provided with a vehicle mounting means 74, best illustrated in FIG. 3, which is used to attach the frame to a vehicle, such as a rubber tired dozer. The mounting means comprise an extending flange having holes 76. The blade of the rubber tired dozer is also provided with a similar flange having holes through which bolts can be inserted thereby joining together the two flanges and anchoring the frame to the dozer.

Figure 4:
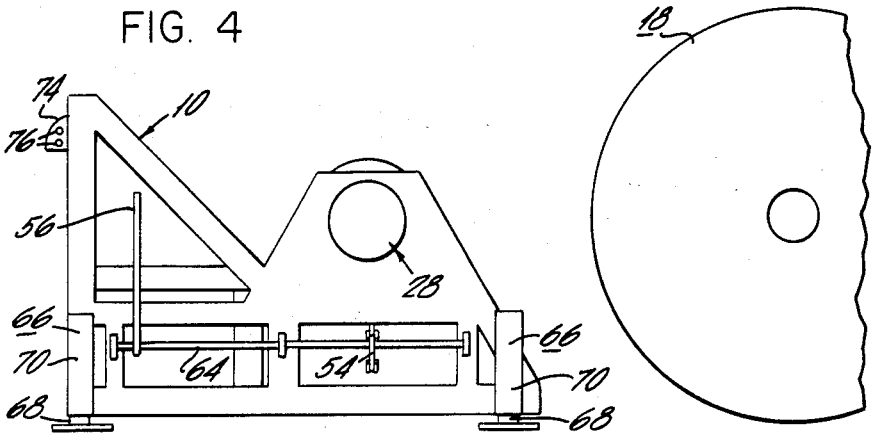

To mount or dismount (see FIG. 4) a cable reel from the apparatus the jack means are first lowered so that a rubber tired dozer can position the split bearing assemblies of the cable receiving portion of the frame under the cable shaft. The apparatus is designed so that the flanges of the cable reel drum maintain the cable shaft at an elevation above the split bearing when the jacks are lowered.

Figure 5:
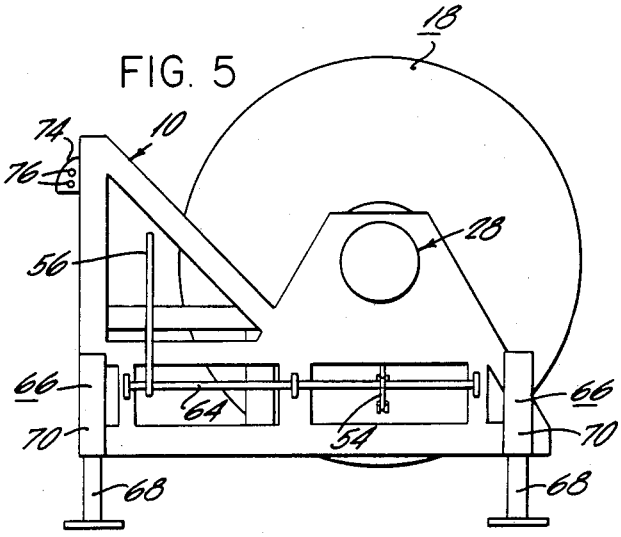

After the reel is in position the apparatus is raised and the jacks appropriately pinned in position, as illustrated in FIG. 5. During this process the split bearings are secured about the cable reel shaft to lock it in place. In this raised condition the cable can be wound about the shaft by actuating the hydraulic motor and the clutch assembly to rotate the cable reel shaft.

Figure 8:
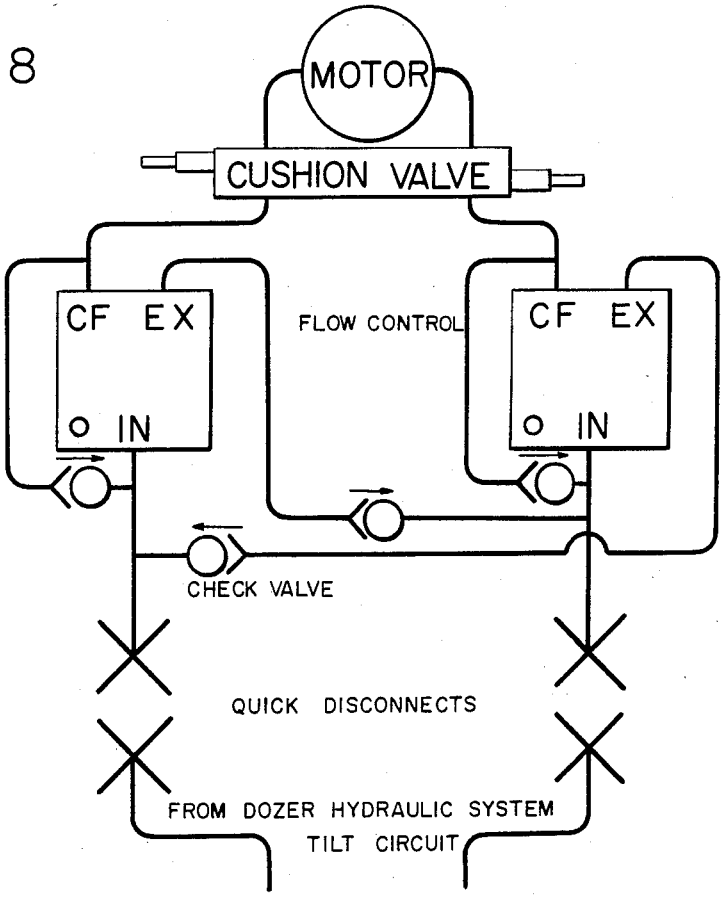
FIG. 8, is a hydraulic fluid schematic for powering the fluid motor.
Figure 6:
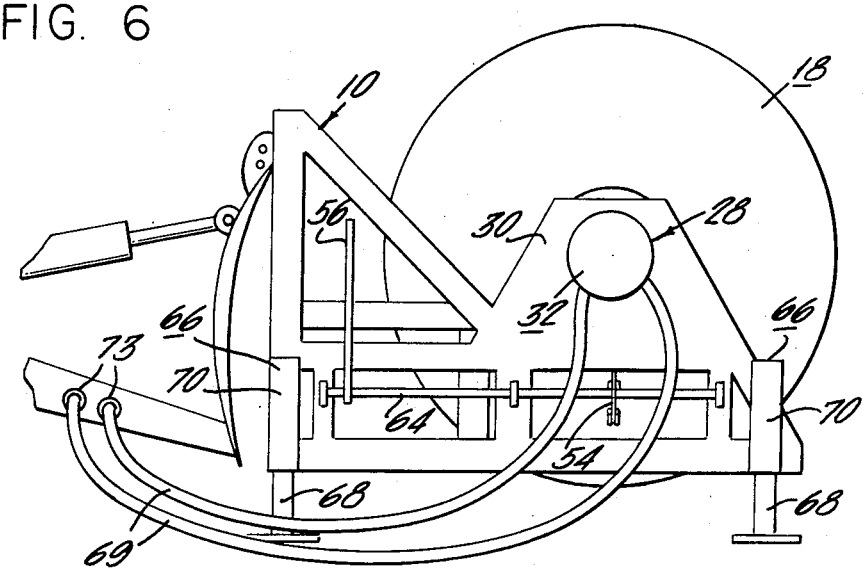

As illustrated in FIG. 6, the hydraulic motor is coupled to the tilt circuit of the dozer by hydraulic hoses 69 each of which is provided with quick disconnect couplings 70 which are attached to the tilt circuit of the dozer. Then by actuating the clutch assembly the rotational movement of the motor is transferred to the cable shaft thereby reeling in the electric power cable. To prevent dragging during rotation, the dozer with frame attached drives along the cable as the cable is being reeled in so that it won't be dragged along the ground. A hydraulic schematic of the hydraulic circuit of the apparatus is illustrated in FIG. 8.

Figure 7:
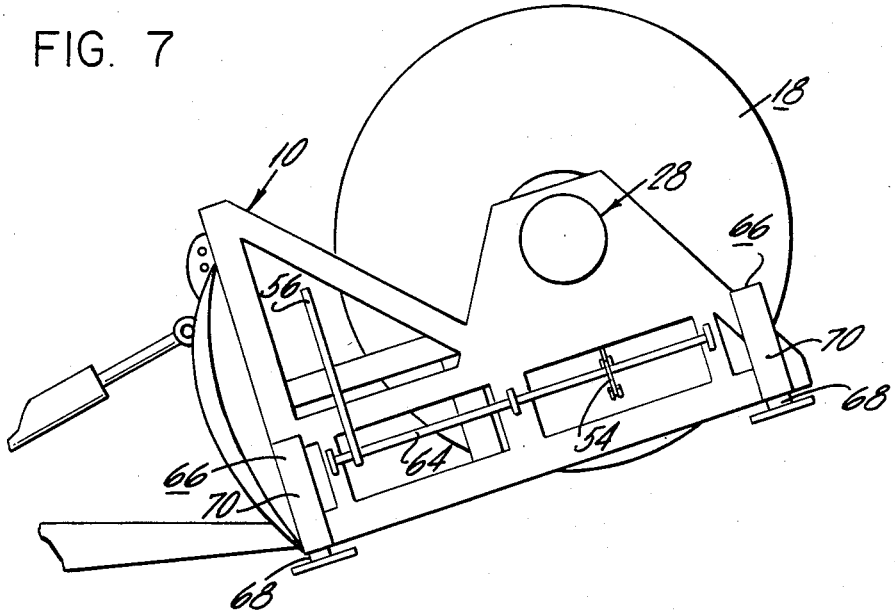

The apparatus is horizontally transported by the dozer by having the dozer lift the apparatus off the ground (see FIG. 7) and then driving the dozer where desired. After the dozer has lifted the frame off the ground it is desirable to push the jack means in, to increase ground clearance during movement.

The apparatus has been disclosed with regards to the illustrated embodiment and should not be so limited, but should be limited solely by the claims that follow.

I claim:

1. A vehicle having a cable reel handling apparatus for moving and reeling electric power cables on associated reels, said vehicle comprising:

a power plant for propelling said vehicle and powering a hydraulic control assembly for controlling and manipulating various elements of said vehicle;

frame means having a reel receiving portion for holding an electric power cable reel;

fluid motor means mounted on a motor receiving portion of the frame means, the fluid motor means being powered by pressurized fluid, the motor means being operationally coupled to an electric power cable reel for reeling in electric power cable;

jacking means mounted on the frame means for supporting the frame means at different vertical positions;

releasable shaft coupling means for holding a shaft of an electric cable reel;

said frame means being adapted, when mounted on a vehicle, to be first moved laterally by said vehicle to position said shaft coupling means in the open position beneath the shaft of a cable reel and then to be moved upwardly to engage said shaft with said coupling means and elevate said reel;

releasable fluid connection means for releasably coupling the fluid motor means to the hydraulic control assembly of said vehicle; and vehicle mounting means on the frame means for detachably mounting the frame means to the vehicle.

2. A cable reel handling apparatus for moving and reeling cable on associated reels, said apparatus comprising:

frame means;

releasable shaft coupling mens having an open position and a closed position, mounted on said frame means;

vehicle mounting means mounted on said frame means;

motor means mounted on said frame means;

connecting means for operationally connecting said motor means to the shaft of a cable reel;

jacking means mounted on the frame means for supporting the frame means at different vertical positions;

said frame means being adapted, when mounted on a vehicle, to be first moved laterally by said vehicle to position said shaft coupling means in the open position beneath the shaft of a cable reel and then to be moved upwardly to engage said shaft with said coupling means and elevate said reel; and said motor means being adapted, when connected to said shaft, to reel in cable on said reel.

3. A cable reel handling apparatus as defined by claim 2 wherein said connecting means comprise a clutch means which selectively operationally couples said motor means to said shaft of a cable reel.

4. A cable reel handling apparatus as defined by claim 2 wherein the releasable shaft coupling means comprises a pair of split bearings mounted on the reel receiving portion of the frame means.

5. A cable reel handling apparatus as defined by claim 3 wherein the clutch means comprises a slidable sleeve and an actuating linkage, the motor means for the apparatus is provided with a rotating shaft, the actuating linkage positions the sleeve along the rotating shaft of the motor means so as to transfer rotational movement from the rotating shaft to a shaft of a cable reel.

6. A cable reel handling apparatus as defined by claim 5 wherein the shaft of the motor means is provided with raised positions and the slidable sleeve of the clutch means is provided with internal grooves which mate with the raised portions of the rotating shaft to transfer rotational movement to the sleeve.

7. A cable reel handling apparatus as defined by claim 4 wherein each of the pair of split bearings comprises a lower bearing member rigidly secured to the frame means and an upper bearing member that is attached to the lower bearing member by pins.

8. A cable reel handling apparatus as defined by claim 2 wherein the frame means is formed of rectangular tubular members.

9. A cable reel handling apparatus as defined by claim 2 wherein the jacking means comprises an outer tube in which is telescoped an inner tube, each tube is provided with registration holes through which a pin can be inserted to maintain the jacking means at the appropriate vertical position.

* * * * *